United States Patent [19]

Yackel, Jr.

[11] 3,930,649

[45] Jan. 6, 1976

[54] TETHERED BALL AND ELLIPTICAL TARGET

[76] Inventor: Harold E. Yackel, Jr., 140 Macobeth St., Rochester, N.Y. 14609

[22] Filed: May 13, 1974

[21] Appl. No.: 469,508

[52] U.S. Cl. ..... 273/101; 273/105 R

[51] Int. Cl.[2] ..... A63B 71/02

[58] Field of Search ..... 273/58 C, 95 A, 98, 101, 273/97 R, 105 R, 102 R, 95 R

[56] References Cited

UNITED STATES PATENTS

| | | | |
|---|---|---|---|
| 3,656,747 | 4/1972 | Revell | 273/98 |
| 3,770,273 | 11/1973 | Reiner | 273/95 A |
| 3,773,330 | 11/1973 | Glass | 273/95 A |

FOREIGN PATENTS OR APPLICATIONS

| | | | |
|---|---|---|---|
| 744,418 | 4/1933 | France | 273/98 |
| 922,362 | 6/1947 | France | 273/98 |

*Primary Examiner*—Richard J. Apley
*Assistant Examiner*—Marvin Siskind

[57] ABSTRACT

This device consists of a base portion to which is secured upright frame portions having a cord or string secured to the upper extermity the cord having a weighted ball on the opposite end which is to be placed into a center mounted ball support.

1 Claim, 5 Drawing Figures

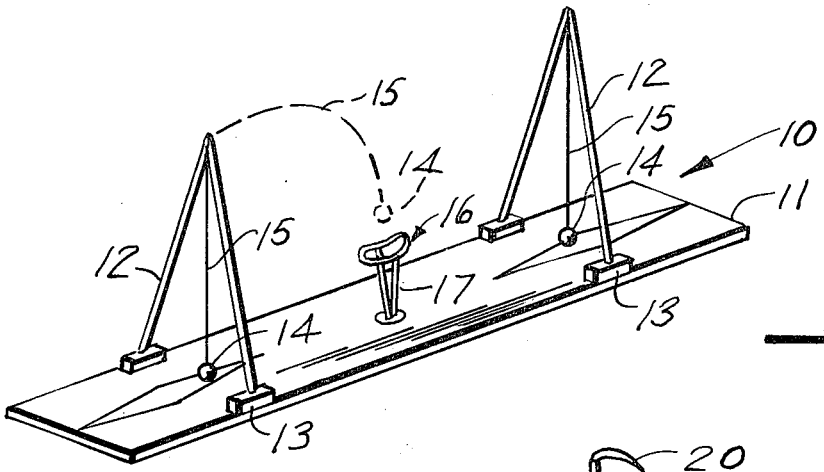
FIG. 1
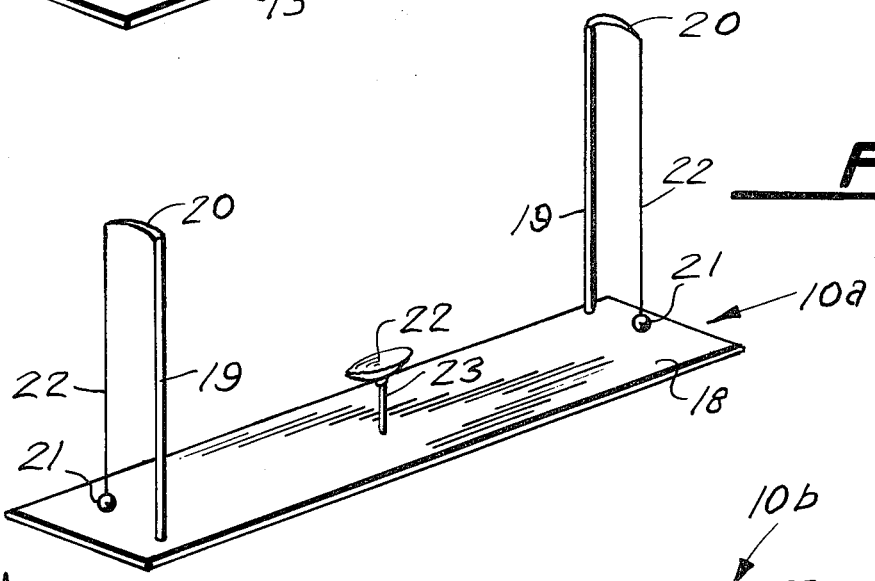
FIG. 2
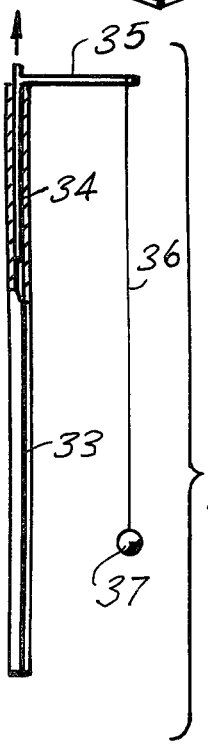
FIG. 3
FIG. 4
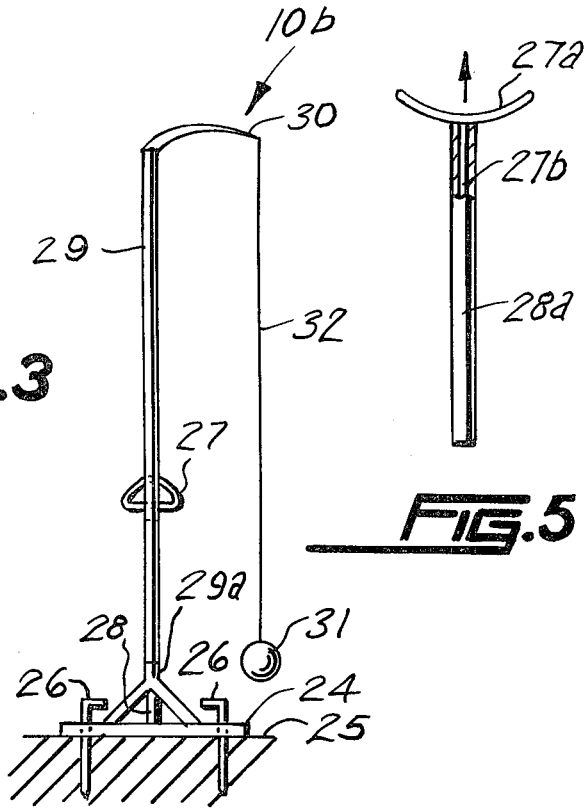
FIG. 5

TETHERED BALL AND ELLIPTICAL TARGET

This invention relates to game devices, and more particularly to a cradle ball device.

It is therefore the principal or primary object of this invention to provide a cradle ball device which may serve as a means of testing the coordination of the user's hand and eye.

Another object of this invention is to provide a cradle ball device which will be adaptable for use indoors as well as outdoors, the device being also adaptable for use with two players or teams.

A further object of this invention is to provide a device of the type described, which will have flat base means to which is secured a pair of spaced apart and inverted, V-shaped frames of which the apex has secured thereto, a cord to which is secured at the opposite end, a weighted ball.

A further objects of this invention is to provide a device of the type described, which will have a ball rest member secured to a central support of the base, the rest member serving to retain the ball after its placement therein.

Other objects of the invention are to provide a cradle ball device which is simple in design, inexpensive to manufacture, rugged in construction, easy to use and efficient in operation.

These and other objects will be readily evident upon a study of the following specification and the accompanying drawing, wherein:

FIG. 1 is a perspective view of the present invention;

FIG. 2 is a perspective view showning a modified form of the invention;

FIG. 3 is an end view showing an outdoor form of the invention;

FIG. 4 is a vertical view showing another modified outdoor form of the invention with a removable post;

FIG. 5 is a vertical view of the ball catching support for use with FIG. 4.

According to this invention, a cradle ball device 10 is shown to include a flat rectangular base 11 to which are attached a pair of spaced apart and V-shaped frames 12, the frames 12 being secured within block portions 13 secured fixedly to the longitudinal edges of base 11. A ball 14 made of glass, hard rubber or other suitable material is secured fixedly in a suitable manner to a string 15 or plastic, the opposite end of the string 15 being secured fixedly within the apex portion of the frames 12. A ball rest or cradle 16 of elliptical shape is secured fixedly to a V-shaped support 17 mounted fixedly within the center of the top of base 11. The ball rest or cradle 16 is surf sized, at the ball 14 will rest in it at the end of it's attached string 15, the dimension being the determining factor of the length of the string.

It will be noted that the ball 14 depends almost to the top surface of base 11 and device 10 is used by picking up the ball 14 and with a swinging action the user lets it drop in the direction of the ball rest 16. Once a player has made a score by the placement of the ball 14 within rest 16, he removes his ball 14 from the ball rest 16 and the game continues on until one side or the other reaches the score that they have decided on to win the game.

Referring now to FIG. 2 of the drawing, a modified form of ball device **10*a* is shown to have a rectangular base 18 to which is secured a pair of spaced apart and upright post members 19 having a spring like end 20 which has a minimum of movement. The post 19 are positioned diagonally from each other and a weighted ball 21 is secured fixedly to string 22 which is secured at its opposite end to the portion 20. A concave ball rest 22 is secured fixedly to a support post 23 carried in the center of base 18 between the post 19. The use of device 10*a* is similar to that of the heretofore described device 10**.

It is to be noted that the ball rest 16 or 22 each are of elliptical shape in which a long axis thereof is aligned to intercept the strings of each of the vertically depending balls. Additionally it is to be noted that when the ball rest 16 is viewed from a side that it is downwardly arcuate in configuration.

Referring now to FIG. 3 of the drawing, an outdoor device **10*b* is shown to include a base member 24 which is secured to the ground 25 by means of a plurality of pins 26 a post member 28 is fixedly secured to the top of base 24 and removeably receives a rod 29 having an upper portion 30. A weighted ball 31 is secured fixedly to a string 32 which is attached at its opposite end, to the portion 30 of member 29. A rest member 27 is removably carried within hollow post 28 which is fixedly secured in the center of base 24**.

Referring now to FIG. 5 of the drawing, a cradle 27a is secured fixedly to a bar 27b which is slideably received within post 28 which may be inserted into the ground in a spaced apart relationship with a hollow post 33. Post 33 removably carries rod 34 having an offset arm portion 35 to which is attached string 36 having a weighted ball 37.

The afore mentioned arrangement of FIGS. 4 and 5 enables the rod portions 34 and bar 27b to be removed from their respective receptacles 33 and 28a.

While various changes may be made in the detail construction, it is understood that such changes will be within the spirit and scope of the present invention as is defined by the appended claims.

What I now claim is:

1. A cradle ball device, comprising a rectangular flat base, a pair of spaced apart and inverted V-frames secured upon said base, a string and ball carried by each said frame, and a ball rest and support member carried by said base, leg portions of said frames being secured within block members, said block members being fixedly secured to a longitudinal edge of said base, each said ball being secured fixedly to one end of each said string, the opposite ends of said strings being fixedly secured and depending from apexes of said frames, each said ball when vertically depending on the said string being spaced just above said base for freedom of swing, said ball rest being centrally positioned between said frames and being elliptical in configuration with a long axis thereof being alined to intercept said strings of said frames when said balls depend vertically, each said ball rest when viewed from a side being downwardly arcuate at its center and opposite extending ends thereof being upwardly turned, the ball rest being secured upon said support member by being mounted upon leg portions thereof which converge downwardly toward an apex mounted upon a center of said base, said ball rest providing a rest means for both said balls.

* * * * *